US010495363B2

(12) United States Patent
Togano et al.

(10) Patent No.: US 10,495,363 B2
(45) Date of Patent: Dec. 3, 2019

(54) CONTROL DEVICE AND CONTROL METHOD FOR BLEED DEVICE

(71) Applicant: MITSUBISHI HEAVY INDUSTRIES THERMAL SYSTEMS, LTD., Tokyo (JP)

(72) Inventors: Yoshie Togano, Tokyo (JP); Kenji Ueda, Tokyo (JP); Noriyuki Matsukura, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 200 days.

(21) Appl. No.: 15/500,370

(22) PCT Filed: Aug. 13, 2015

(86) PCT No.: PCT/JP2015/072903
§ 371 (c)(1),
(2) Date: Jan. 30, 2017

(87) PCT Pub. No.: WO2016/047305
PCT Pub. Date: Mar. 31, 2016

(65) Prior Publication Data

US 2017/0219260 A1 Aug. 3, 2017

(30) Foreign Application Priority Data

Sep. 25, 2014 (JP) ..... 2014-195090

(51) Int. Cl.
*F25B 43/04* (2006.01)
*F25B 49/02* (2006.01)

(52) U.S. Cl.
CPC ..... *F25B 43/043* (2013.01); *F25B 49/02* (2013.01); *F25B 2700/21161* (2013.01); *F25B 2700/21172* (2013.01); *F25B 2700/21173* (2013.01)

(58) Field of Classification Search
CPC .. F25B 43/043; F25B 49/02; F25B 2700/195; F25B 2700/197; F25B 2500/19;
(Continued)

(56) References Cited

U.S. PATENT DOCUMENTS 4,864,829 A * 9/1989 Manning ..... F25B 47/00 62/85
5,355,685 A * 10/1994 Stie ..... F25B 43/043 62/195
(Continued)

FOREIGN PATENT DOCUMENTS

JP 6-241624 A 9/1994
JP 2000-292033 A 10/2000
(Continued)

OTHER PUBLICATIONS

Temperature and Pressure Chart for Refrigerants, National Refrigerants</i>.*
(Continued)

*Primary Examiner* — Frantz F Jules
*Assistant Examiner* — Schyler S Sanks
(74) *Attorney, Agent, or Firm* — Birch, Stewart, Kolasch & Birch, LLP

(57) ABSTRACT

The purpose of the present invention is to achieve stable operation when using a low pressure, low GWP refrigerant. In the present invention, a control device (16) is provided with an estimation unit (31), a determination unit (32), and an activation control unit (33). The estimation unit (31) estimates the amount of air entering using a degree of
(Continued)

influence of air entering, which represents the ease with which air enters determined by the structure of the chiller, and a variable obtained by a function including pressure as a parameter. The determination unit (32) determines whether a total value for the amount of air entering is greater than or equal to a preset tolerance value. The activation control unit (33) activates a bleed device when the total value of the amount of air entering is equal to or greater than the tolerance value.

12 Claims, 3 Drawing Sheets

(58) Field of Classification Search
CPC ..... F25B 2500/22; F25B 2500/221; F25B 2500/222; F25B 2600/25; F25B 2600/2525; F25B 25/005

See application file for complete search history.

(56) References Cited

U.S. PATENT DOCUMENTS

| | | | | |
|---|---|---|---|---|
| 2002/0173929 | A1* | 11/2002 | Seigel | F24F 11/30 702/130 |
| 2011/0079040 | A1 | 4/2011 | Morimoto et al. | |
| 2012/0227681 | A1* | 9/2012 | Min | F24H 9/122 122/13.3 |

FOREIGN PATENT DOCUMENTS

| | | | |
|---|---|---|---|
| JP | 2001-116427 | A | 4/2001 |
| JP | 2004-44901 | A | 2/2004 |
| JP | 2008-14598 | A | 1/2006 |
| JP | 2011-237146 | A | 11/2011 |
| WO | WO 2009/157325 | A1 | 12/2009 |

OTHER PUBLICATIONS

Improved Approach for Estimating Leak and Break Frequencies of Piping Systems in Probablistic Safety Assesment, Berg et al, 2009.*

* cited by examiner

CONTROL DEVICE AND CONTROL METHOD FOR BLEED DEVICE

TECHNICAL FIELD

The present invention relates to chillers and particularly to a control device and a control method for a bleed device.

BACKGROUND ART

In negative pressure chillers that use a low-pressure refrigerant, water-containing noncondensable gas (mainly air) and air enters the chiller and collects in the condenser and the like. In this state, the noncondensable gas raises the condensing pressure which may cause operation to fail, and the water may cause corrosion inside the chiller. Thus, conventional chillers are known that include a bleed device that discharges the noncondensable gas that has entered the chiller to the atmosphere (see for example Patent Documents 1 and 2).

For example, Patent Document 1 describes a configuration in which noncondensable gas is accumulated inside a purge condenser, and when the pressure inside the purge condenser rises so that the difference between it and the pressure in the condenser falls to a predetermined value, the noncondensable gas inside the purge condenser is discharged to the atmosphere.

CITATION LIST

Patent Document

Patent Document 1: Japanese Unexamined Patent Application Publication No. 2000-292033A Patent Document 2: Japanese Unexamined Patent Application Publication No. 2008-014598A

SUMMARY OF INVENTION

Technical Problems

Recently, the revisions of a so-called "Fluorocarbons Recovery and Destruction Law" and the adoption by the European Union of F-gas regulation has created a strong demand for the use of low global warming potential (GWP) refrigerants. Low GWP refrigerants contain an alkene bond in their molecular structures and are thus easily broken down by oxygen, and depending on the constituent elements, produce by-products that affect the stable operation of the chiller such as hydrogen fluoride and hydrogen chloride. Thus, chillers that use a low pressure, low GWP refrigerant require highly precise control of the noncondensable gas inside the chiller beyond that of conventional means to ensure stable operation.

However, the conventional method, describe above, of discharging the noncondensable gas on the basis of the difference in pressure is not sensitive enough to ensure that the amount of noncondensable gas inside the chiller will not reach levels whereby stable operation is inhibited, and cannot achieve stable operation.

In light of the foregoing, an object of the present invention is to provide a control device and a control method for a bleed device for chillers using a low pressure, low GWP refrigerant that enables stable operation.

Solution to Problems

A first aspect of the present invention is a control device that controls a bleed device provided on a chiller that uses low pressure, low global warming potential refrigerant. The control device comprises: an estimation unit that estimates an amount of air entering using a degree of influence of air entering representing ease with which air enters the chiller determined by a structure of the chiller, and a variable obtained from a function including pressure as a parameter; a determination unit that determines whether a total value of the amount of air entering is equal to or greater than a preset tolerance value; and an activation control unit that activates the bleed device when the total value of the amount of air entering is equal to or greater than the tolerance value.

According to the present aspect, the amount of air entering is estimated by the estimation unit, whether the total value of the amount of air entering is equal to or greater than the preset tolerance value is determined by the determination unit, and if the total value of the amount of air entering is equal to or greater than the tolerance value, the bleed device is activated by the activation control unit. This configuration can maintain the amount of air entering inside the chiller to a value equal to or less than the tolerance value.

The estimation unit estimates the amount of air entering using the degree of influence of air entering, which represents the ease with which air enters the chiller determined by the structure of the chiller and a variable, which represents the ease with which air enters the chiller evaluated in terms of pressure. In such a manner, in the present aspect, "structure of the chiller" and "pressure" are given as two elements that affect air entering the chiller. The amount of air entering is estimated from the perspective of these two elements.

"Tolerance value" refers to, for example, a set value greater than zero that is less than an amount of air entering that would cause the break down of the refrigerant or the inhibition of the stable operation of the chiller.

"Low pressure, low global warming potential refrigerant" and "low pressure" refers to a refrigerant able to become negative pressure (has pressure equal to or less than atmospheric pressure) either partially or wholly for even a short period of time all year round irrespective of whether the chiller is in operation of stopped.

"Low global warming potential refrigerant" refers to, for example, refrigerants such as alternative refrigerants as per HFC refrigerant regulations to prevent global warming (for example, R1234yf (4), R1234ze(E) (4), R1233zd(E) (5), R32 (675), and the like (note that the number in brackets represents the 100-year global warming potential value)) or refrigerants with similar global warming potential values (100-year values).

"Pressure" refers to, for example, pressure measured by a pressure gauge provided in an area inside the chiller, or alternatively in cases in which a plurality of pressure gauges are provided inside the chiller, the average value, the lowest value, or the highest value of the measured values. "Pressure" may refer to a value obtained from converting temperature to pressure.

In the control device described above, the estimation unit may estimate an amount of air entering using a difference between pressure inside the chiller and atmospheric pressure and the degree of influence of air entering.

In the control device(s) described above, the chiller may be divided into a plurality of sections; the degree of influence of air entering may be set for each of the sections; and the estimation unit may estimate an amount of air entering for each of the sections, and may estimate an amount of air entering for the entire chiller from the estimated amount of air entering for each of the sections.

According to the control device(s) described above, the amount of air entering is estimated for each section, thus enabling the amount of air entering inside the chiller to be more precisely estimated.

In the control device(s) described above, for example, the degree of influence of air entering may be set according to a joint structure and a number of joints.

A second aspect of the present invention is a chiller that uses low pressure, low global warming potential refrigerant, comprising a bleed device; and any one of the control devices described above.

A third aspect of the present invention is a control method for a bleed device provided on a chiller that uses low pressure, low global warming potential refrigerant. The method comprises estimating an amount of air entering using a degree of influence of air entering representing ease with which air enters the chiller determined by a structure of the chiller, and a variable obtained from a function including pressure as a parameter; determining whether a total value of the amount of air entering is equal to or greater than a preset tolerance value; and activation controlling to activate the bleed device when the total value of the amount of air entering is equal to or greater than the tolerance value.

Advantageous Effects of Invention

According to the present invention, stable operation can be achieved using a low pressure, low global warming potential refrigerant.

DESCRIPTION OF EMBODIMENTS

First Embodiment

A control device and a control method for a bleed device according to a first embodiment of the present invention are described below with reference to the drawings.

Figure 1:
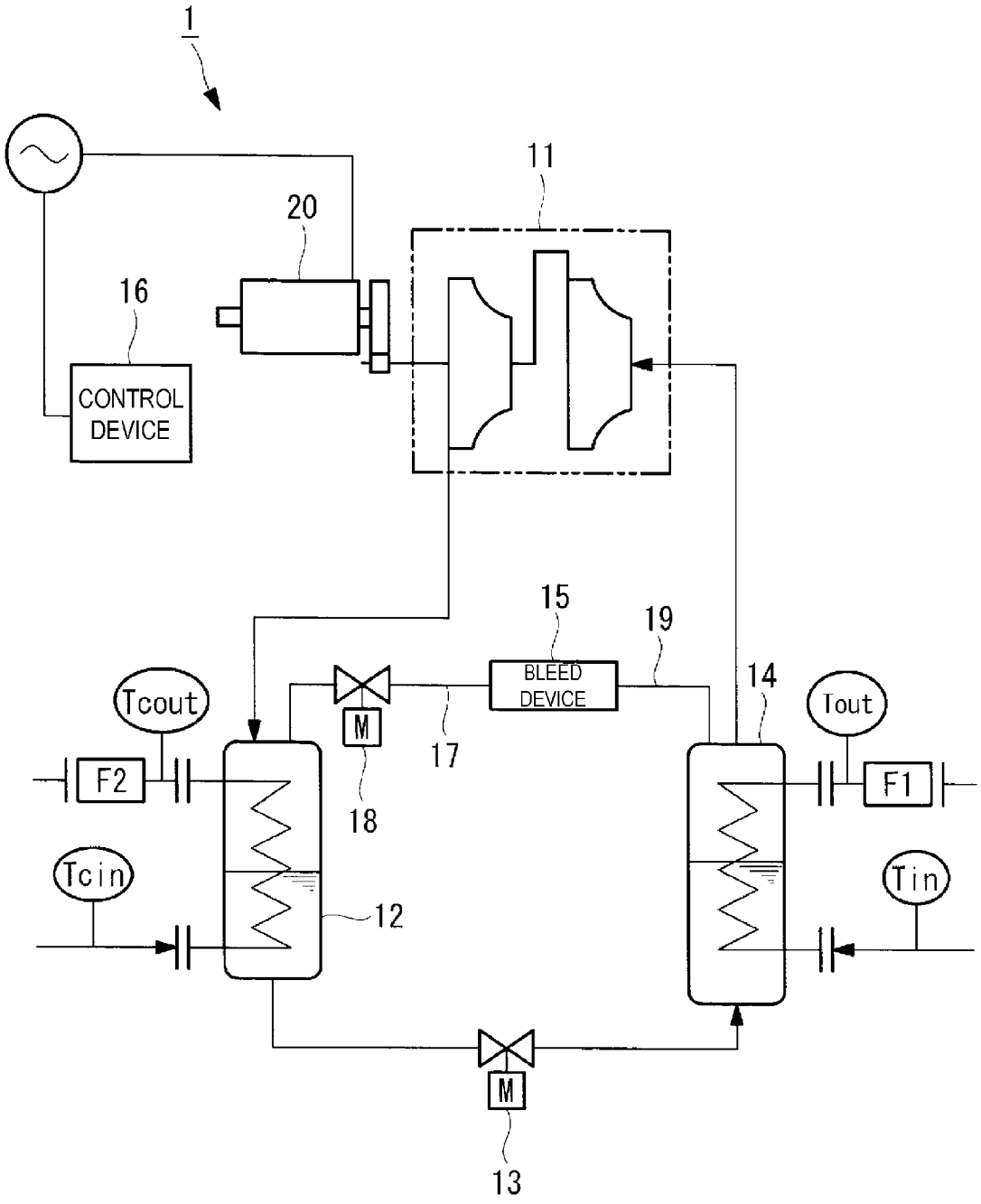
FIG. 1 is a diagram illustrating a schematic configuration of a chiller according to a first embodiment of the present invention.

FIG. 1 is a diagram illustrating a schematic configuration of a chiller according to the first embodiment of the present invention. As illustrated in FIG. 1, a chiller 1 according to the present embodiment is a compression-type chiller. The chiller 1 includes as main components a compressor 11 that compresses a refrigerant, a condenser 12 that condenses high-temperature, high-pressure gas refrigerant compressed by the compressor 11, an expansion valve 13 that expands the liquid refrigerant flowing from the condenser 12, an evaporator 14 that evaporates the liquid refrigerant expanded by the expansion valve 13, a bleed device 15 that discharges air that has entered the chiller 1 to the atmosphere, and a control device 16 that controls the devices/units that compose the chiller 1.

The refrigerant used is a low pressure, low GWP refrigerant.

The compressor 11 is a multi-stage centrifugal compressor driven by an inverter motor 20, for example. The bleed device 15 is connected to the condenser 12 via piping 17. The refrigerant gas (containing air) is guided from the condenser 12 through the piping 17 to the bleed device 15. A valve 18 is provided on the piping 17 that controls the flow or interrupts the flow of the refrigerant gas. The valve 18 is controlled by the control device 16 to open and close to control the activation or deactivation of the bleed device.

The bleed device 15, for example, includes as main components a bleed tank (not illustrated) that condenses the refrigerant gas supplied through the piping 17 and separates it from the noncondensable gas, and an adsorption tank (not illustrated) that removes minute amounts of refrigerant contained in the noncondensable gas. The noncondensable gas from which refrigerant has been removed via the adsorption tank is discharged to the atmosphere. The refrigerant gas separated from the noncondensable gas at the bleed tank is returned to the evaporator 14 through piping 19. The bleed device 15 is not limited to this example configuration.

The chiller 1 is provided with temperature sensors for measuring cold water inlet temperature Tin, cold water outlet temperature Tout, cooling fluid inlet temperature Tcin, and cooling fluid outlet temperature Tcout; a flow rate sensor for measuring cold water flow rate F1 and cooling fluid flow rate F2; and the like. The measurement values from the sensors are sent to the control device 16 and used to control the chiller 1.

The chiller 1 illustrated in FIG. 1 is not limited to this example configuration. For example, instead of the condenser 12, an air heat exchanger may be disposed so that heat exchange between the cooled outside air and the refrigerant is provided. Also, the chiller 1 is not limited to only having a cooling function, and, for example, may have only a heating function or both a cooling and heating function.

The control device 16 has the function of controlling the rpm of the compressor 11 on the basis of the measured values sent from the sensors, the load percentage sent from higher systems, and the like; the function of controlling the bleed device 15; and the like.

The control device 16, for example, is provided with a central processing unit (CPU), random access memory (RAM) or other similar memory, computer readable recording medium, and the like (not illustrated). A sequence of processing for performing various functions described below is stored on a recording medium or the like in the form of a program, and the various functions described below are performed by the CPU loading this program from the recording medium into the RAM or the like, and executing information processing and calculation processing.

Figure 2:
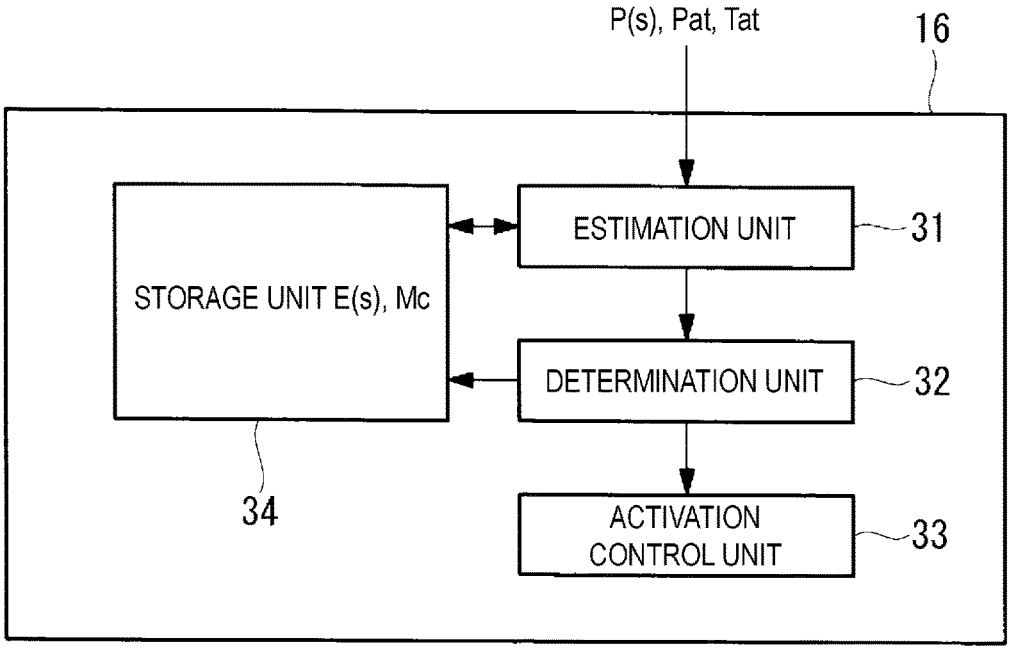
FIG. 2 is a functional block diagram of a control device according to the first embodiment of the present invention.

FIG. 2 is a functional block diagram illustrating the function of the control device 16 of controlling the bleed device 15. As illustrated in FIG. 2, the control device 16 is provided with an estimation unit 31, a determination unit 32, an activation control unit 33, and a storage unit 34.

The estimation unit 31 estimates the amount of air entering using a degree of influence of air entering, which represents the ease with which air enters determined by the structure of the chiller 1, and a variable obtained by a function including pressure as a parameter.

The degree of influence of air entering, for example, is an index value representing the degree to which gaps exist that allow air (oxygen) to enter the chiller 1. This index value is stored in advance in the storage unit 34. The degree of influence of air entering, for example, is determined by the structure, size, and number of the joints connecting the piping and the like. The degree of influence of air entering may also be set taking into consideration information on resin material through which the air may enter. The method of determining the degree of influence of air entering is described in detail below.

In the present embodiment, the chiller 1 is divided into a plurality of sections, and the degree of influence of air entering is set for each section.

Note that sections can be divided as appropriate. For example, depending on the operation condition (for example, whether in operation or operation is stopped) and whether it is winter or summer, sections may be divided so that areas with the same tendencies from the perspective of easiness to become negative pressure are grouped as one section. For example, in summer, the surroundings of the evaporator easily become negative pressure. In winter, both during operation and when operation is stopped, the areas other than the fuel supply system easily becomes negative pressure. Taking into account such tendencies, for example, the surroundings of the evaporator may be defined as one section, and other areas such as the surroundings of the compressor and condenser may be defined as one section.

The estimation unit 31, for example, estimates the amount of air entering each section using the degree of influence of air entering set for each section, the pressure of each section, and the atmospheric pressure. Specifically, when the pressure in a section is higher than the atmospheric pressure, in other words has positive pressure, the amount of air entering is zero. When the pressure in a section is lower than the atmospheric pressure, in other words has negative pressure, the amount of air entering is estimated as the square root of the pressure difference between the pressure and the atmospheric pressure multiplied by the degree of influence of air entering. This formula is shown in Formula (1) and Formula (2) below.

$$\text{When } P(s) - Pat \geq 0 \text{ (positive pressure)} \quad (1)$$
$$M(s) = 0$$

$$\text{When } P(s) - Pat < 0 \text{ (negative pressure)} \quad (2)$$
$$M(s) = E(s) \times f(P(s), Pat) = E(s) \times \sqrt{|P(s) - Pat|}$$

In Formula (1) and Formula (2) above, P(s) is the pressure (Pa (abs)) of section s, Pat is the atmospheric pressure (Pa (abs)), M(s) is the amount of air entering section s ($m^3$), and E(s) is the degree of influence of air entering section s ($m^3$/Pa); and the details thereof are described below. The unit for the amount of air entering is not limited to ($m^3$) described above and, for example, may be kg, mol, or the like.

When the amount of air entering is estimated for each section in such a manner, the estimation unit 31 adds the total value of the amount of air entering of all sections to the previous total value for the amount of air entering. Thus, the total value for the amount of air entering, or in other words the total amount of air entering the entire chiller at present, is calculated. The formula is shown in Formula (3) below.

$$M(t)=M(t-1)+\Sigma M(s) \quad (3)$$

In Formula (3), M(t) is the total value of the amount of air entering at present, M(t−1) is the previous total value of the amount of air entering, and ΣM(s) is the calculated present total value of the amount of air entering each section.

The determination unit 32 determines whether a total value for the amount of air entering at present calculated by the estimation unit 31 is greater than or equal to a preset tolerance value.

The tolerance value, for example, is set on the basis of tests or operational performance for chemical stability of the refrigerant. For example, the amount of air produced by the breaking down of the refrigerant or the amount of air entering that does not inhibit stable operation of the chiller may be obtained via tests or operational performance, and the tolerance value may be set to a value less than this amount of air entering.

Here, the unit for the tolerance value and the unit for the total value of the amount of air entering calculated by the estimation unit 31 are required to match. For example, in embodiments in which the unit for the tolerance value is mol and the unit for the total value of the amount of air entering is a unit other than mol, the total value of the amount of air entering is converted to the unit for the tolerance value mol, and then the total value of the amount of air entering and the tolerance value are compared. For example, in embodiments in which the unit for the total value of the amount of air entering is $m^3$, the conversion formula Formula (4) below can be used to find the total value of the amount of air entering in mol.

$$M(t)'=R\times Tat/(Pat\times M(t)) \quad (4)$$

In Formula (4), M(t)' is the total value of the amount of air entering at present in mol, R is the gas constant (J/(mol·K)), and Tat is the ambient temperature (K).

Above, converting the unit for the total value of the amount of air entering to that of the tolerance value has been described. However, the unit for the tolerance value may be converted to match the unit for the total value of the amount of air entering.

Conversion of the units may be carried out when finding the amount of air entering M(s) for each section. For example, by converting the amount of air entering M(s) of each section found via Formula (2) described above to mol to get the amount of air entering M(s)', and then adding together the M(s)' and the previous total value of the amount of air entering M(t−1)' in mol, the total value of the amount of air entering M(t)' in mol can be obtained.

The activation control unit 33 activates the bleed device 15 when the total value of the amount of air entering at present is equal to or greater than the tolerance value. For example, the activation control unit 33 opens the valve 18 provided on the piping 17 to activate the bleed device 15. The time for which the bleed device 15 continuously operates may be set according to the ratio of the amount of air entering the entire chiller to the volume of the chiller. Additionally, the time for which the bleed device 15 continuously operates may be set to the time required to discharge a sufficient amount of air determined in advance.

In embodiments in which the continuous operation time is set according to the ratio of the amount of air entering the entire chiller to the volume of the chiller, Formula (5) may be used, for example.

$$tc=f[Vnc/Vc] \quad (5)$$

$$Vnc=f[M(t)] \quad (6)$$

In Formula (5), tc is the time (s) for which the bleed device 15 continuously operates, Vnc is the volume ($m^3$) of gas for bleeding calculated by Formula (6) above. Vc is the volume ($m^3$) inside the chiller.

The time for which the bleed device 15 continuously operates tc may be calculated using Formula (7) below using the volume of gas for bleeding and the intake capacity of the bleed device 15 as parameters.

$$tc=f[Vnc/va] \quad (7)$$

In Formula (7), va is the intake capacity ($m^3/s$) of the bleed device 15.

The activation control unit 33 does not activate the bleed device 15 when the total value of the amount of air entering at present is less than the tolerance value.

In the storage unit 34, information referenced in processing by the estimation unit 31 and the determination unit 32 is stored in advance. For example, the degree of influence of air entering E(s) of each section, the tolerance value Mc, and other constants contained in Formulas (1) to (7) are entered in advance.

Next, the degree of influence of air entering E(s) of each section described above will be described.

The degree of influence of air entering E(s) of each section is determined via the following method on the basis of the structure, size, and number of the joints in each section.

First, the length of the gap for each joint structure is found. This formula is shown in Formula (8) below.

$$L(i,s)=\Sigma\{N(i,k,s)\times l(i,k)\} \quad (8)$$

In Formula (8), i is the joint structure, s is the section, L(i,s) is the total gap length (mm) of the joint structure i of section s, k is the joint size, N(i,k,s) is the number of joint structures i and joint size k in section s, l(i,k) is the gap length (mm) of the joint structure i and joint size k.

Next, by multiplying the total gap length of each joint structure by a coefficient corresponding to the ease with which air enters depending on the joint structure, the degree of influence of air entering of each joint structure can be calculated; and by finding the total, the degree of influence of air entering is determined. This formula is shown in Formula (9) below.

$$E(s)=\Sigma\{L(i,s)\times W(i)\} \quad (9)$$

In Formula (9), E(s) is the degree of influence of air entering ($m^3$/mm·Pa) of section s, W(i) is the coefficient ($m^3$/mm·Pa) representing the ease of air entering joint structure i. The ease of air entering varies depending on the joint structure. For example, joint structures that are butt welded or socket welded are relatively resistant to air entering. Joint structures with a threaded joint, a union joint, flange joint, bite-type joint, flare joint, and the like are more susceptible to air entering than the welding methods described above. Coefficient W(i) is a larger value the easier it is for air to enter the joint structure.

By using this method for each section, the degree of influence of air entering of the sections is calculated. The degree of influence of air entering of each section is stored in the storage unit 34 and used in the estimation of the amount of air entering described above.

Figure 3:
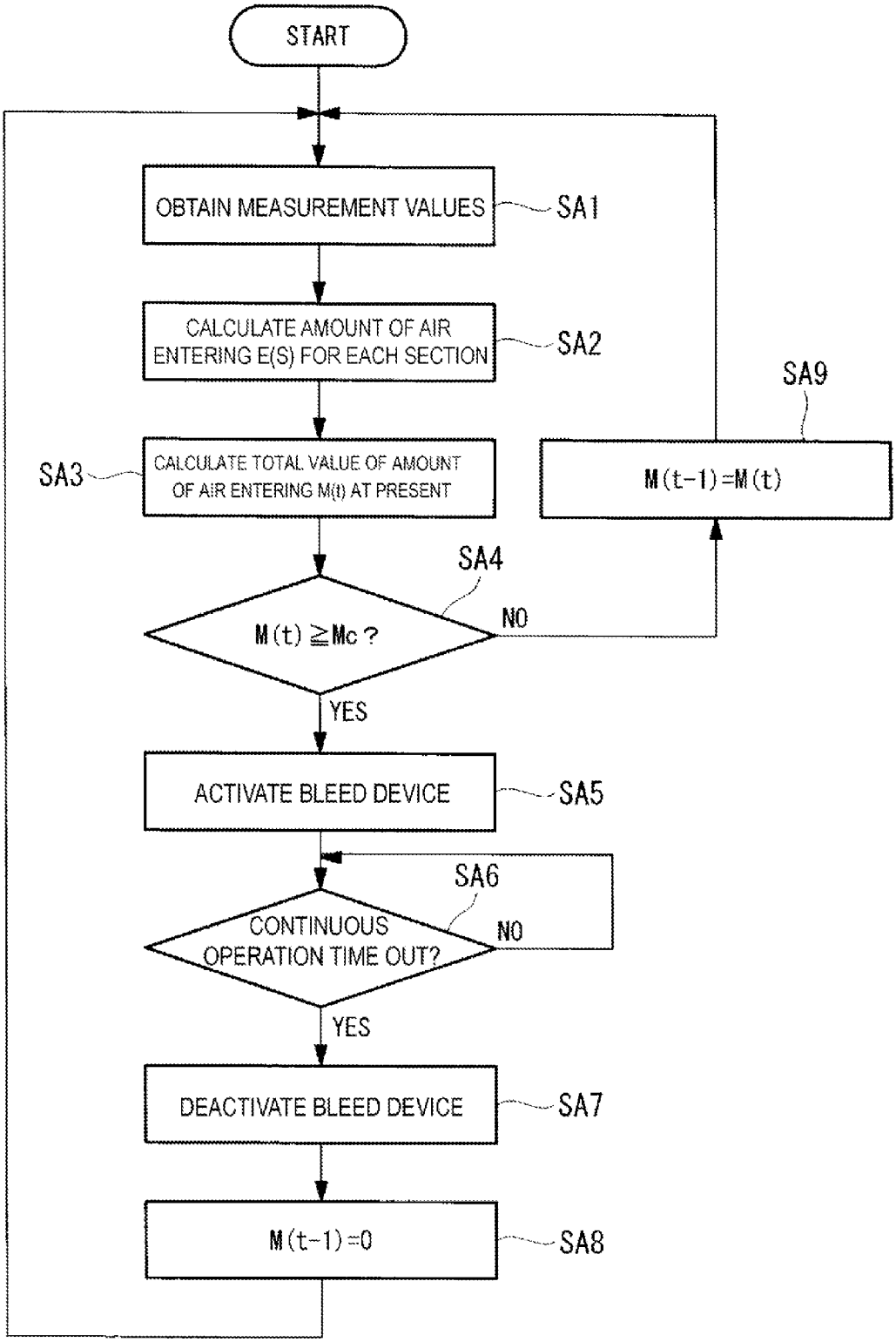
FIG. 3 is a flow diagram of a process executed by the control device according to the first embodiment of the present invention.

Next, the method of controlling the bleed device 15 by the control device 16 described above is described with reference to FIG. 3.

First, the sensors (for example, a pressure sensor, a temperature sensor (not illustrated in FIG. 1)) provided inside and near the chiller obtain measurement values for pressure P(s), atmospheric pressure Pat, ambient temperature Tat, and the like for each section (step SA1).

Next, the amount of air entering M(s) each section is calculated using the pressure P(s) and the atmospheric pressure Pat of each section (step SA2).

Then, by adding the value ΣM(s) of the added amount of air entering M(s) for each section together with the previous total value M(t−1), the total value M(t) of the amount of air entering at present is calculated (step SA3).

Next, it is determined whether the total value M(t) of the amount of air entering at present is equal to or greater than the tolerance value Mc or not (step SA4). Here, in embodiments in which the units of the values do not match, processing is done to convert one to match the other before they are compared.

In step SA4, if the total value M(t) of the amount of air entering is equal to or greater than the tolerance value Mc, the bleed device 15 is activated (step SA5). Next, whether the continuous operation time has timed out or not is determined (step SA6), and if timed out, the bleed device 15 is stopped (step SA7).

Thereafter, the previous total value M(t−1) of the amount of air entering is set to zero (step SA8), and the process returns to step SA1 described above.

In step SA4, if the total value M(t) of the amount of air entering is less than the tolerance value Mc, the previous total value M(t−1) of the amount of air entering is set as the present calculated total value M(t) of the amount of air entering (step SA9), and the process returns to step SA1. The process described above then repeats.

The process described above, for example, is carried out, without interruption, at fixed intervals regardless of whether the chiller 1 is in operation or not.

As described above, according to the control device and control method for a bleed device according to the present embodiment, the amount of air entering at present is estimated by the estimation unit 31, whether the total value of the amount of air entering at present is equal to or greater than the tolerance value is determined by the determination unit 32, and if the total value of the amount of air entering at present is equal to or greater than the tolerance value, the bleed device 15 is activated by the activation control unit 33.

This configuration can maintain the amount of air entering the chiller to a value equal to or less than the tolerance value. As a result, breaking down of the refrigerant can be prevented, and thus by-products that affect the stable operation of the chiller such as hydrogen fluoride and hydrogen chloride can be prevented from being produced.

The determination method for the degree of influence of air entering is not limited to the method described above. For example, the differences (for example, joint structure, number, and the like) between the chiller and a hypothetical reference chiller with a known degree of influence of air entering (referred to as "reference chiller" below) can be used to relatively determine the degree of influence of air entering for each section. For example, if the target chiller has more joints and air more easily enters the joint structure than the reference chiller, the degree of influence of air entering is set higher than that of the reference chiller. If the opposite is true and the target chiller has less joints and the joint structure is more resistant to air entering, the degree of influence of air entering is set relatively lower than that of the reference chiller.

Second Embodiment

Next, a control device and a control method for a bleed device according to a second embodiment of the present invention are described.

In the first embodiment described above, the amount of air entering each section is estimated. However, the present embodiment differs in that the amount of air entering the entire chiller is directly estimated without dividing the chiller into sections. In other words, for the chiller of the present embodiment, the method of calculating the total value M(t) of the amount of air entering by the estimation unit 31 differs from that of the first embodiment. The chiller according to the present embodiment is described below focusing mainly on the differences from the first embodiment.

The estimation unit according to the present embodiment calculates the total value M(t) of the amount of air entering at present using Formula (10) below.

$$M(t)=Mb\times f(Ec'/Vc)\times f(Pet,Pct)+M(t-1) \quad (10)$$

In Formula (10) above, Mb is the amount of air entering the reference chiller, f(Ec'/Vc) is a function including the degree of influence of air entering and the volume inside the chiller as parameters, Ec' is degree of influence of air entering of the entire chiller relatively determined on the basis of the difference in structure from the reference chiller, Vc is the volume inside the chiller, f(Pet,Pct) is a function including evaporating pressure Pet and condensing pressure Pct as parameters.

As shown in Formula (10), by multiplying the function f(Ec'/Vc) including the degree of influence of air entering and the volume inside the chiller as parameters and the function f(Pet,Pct) including the evaporating pressure Pet and the condensing pressure Pct as parameters by the amount of air entering Mb of the reference chiller with the amount of air entering being known by actual measurements, and the like, and then adding to this value the previous total value M(t−1) of the amount of air entering, the total value of the amount of air entering at present is calculated.

Here, the function f(Ec'/Vc) including the degree of influence of air entering and the volume inside the chiller as parameters functions as a coefficient representing the relative ease of air entering determined by the structure. In other words, larger values for this function indicates air more easily entering compared to the reference chiller in terms of the structure. The function f(Pet,Pct) including the evaporating pressure and the condensing pressure functions as a coefficient representing the ease of air entering in terms of pressure (the difference in pressure from the atmospheric pressure). In other words, air more easily enters the more negative the evaporating pressure and the condensing pressure is. Accordingly, larger values of the function indicate air more easily entering in terms of pressure.

According to the control device and the control method for a bleed device of a chiller according to the present embodiment, the processing load when calculating the amount of air entering can be reduced due to the removal of the requirement to divide the chiller into sections as in the first embodiment. Furthermore, by using the value for the degree of influence of air entering relatively determined from the difference in structure from the reference chiller, labor when determining the degree of influence of air entering can be reduced.

The present invention is not limited to the invention according to the embodiments described above, and modifications within the scope of the invention can be made.

For example, in the embodiments described above, the control device 16 of the chiller functions to control the bleed device 15. However, the present invention is not limited thereto, and the control function of the bleed device 15 may be transferred from the control device 16 to a dedicated control device for the bleed device separately provided.

In the embodiments described above, the bleed device 15 is connected to the condenser 12 via the piping 17. However, if there are areas where air easily collects other than the condenser 12, the bleed device 15 may be connected to these areas via other piping. By connecting areas where air easily collects and the bleed device 15, air inside the device can be efficiently discharged.

In the embodiments described above, the bleed device 15 is activated on the basis of the amount of air entering. However, the refrigerant may also be degraded by water and other such substances. Accordingly, as well as the amount of air entering, the amount of water and other such substances entering may be estimated, and depending on the estimated amount, a unit that removes or reduces such substances may be controlled to activate or deactivate. A structure able to constantly remove other substances (water removal via a filter dryer, for example) may be provided, or a configuration may be employed in which other substances are constantly removed.

REFERENCE SIGNS LIST

1 Chiller
11 Compressor
12 Condenser
13 Expansion valve
14 Evaporator
15 Bleed device
16 Control device
17, 19 Piping
18 Valve
31 Estimation unit
32 Determination unit
33 Activation control unit
34 Storage unit

The invention claimed is:

1. A control device that controls a bleed device provided on a chiller that uses low pressure, low global warming potential refrigerant, the control device comprising:
- a processor configured to perform as:
- an estimation unit that estimates an amount of air entering the chiller, using:
- a degree of influence of air entering representing ease with which air enters the chiller determined by a structure of the chiller, and
- a variable obtained from a function including pressure as a parameter;
- a determination unit that determines whether a total value of the amount of air entering is equal to or greater than a preset tolerance value; and
- an activation control unit that activates the bleed device when the total value of the amount of air entering is equal to or greater than the tolerance value.

2. The control device according to claim 1, wherein the estimation unit estimates an amount of air entering, using the degree of influence of air entering, and a difference between pressure inside the chiller and atmospheric pressure.

3. The control device according to claim 1, wherein
- the chiller is divided into a plurality of sections;
- the degree of influence of air entering is set for each of the sections; and
- the estimation unit estimates an amount of air entering for each of the sections, and estimates an amount of air entering for the entire chiller from the amount of air entering for each of the sections.

4. The control device according to claim 1, wherein the degree of influence of air entering is set according to a joint structure and a number of joints.

5. A chiller that uses low pressure, low global warming potential refrigerant, comprising:

a bleed device; and the control device according to claim 1.

6. A control method for a bleed device provided on a chiller that uses low pressure, low global warming potential refrigerant, the method comprising:

estimating an amount of air entering the chiller, using:

a degree of influence of air entering representing ease with which air enters the chiller determined by a structure of the chiller, and a variable obtained from a function including pressure as a parameter;

determining whether a total value of the amount of air entering is equal to or greater than a preset tolerance value; and activation controlling to activate the bleed device when the total value of the amount of air entering is equal to or greater than the tolerance value.

7. The control device according to claim 2, wherein the chiller is divided into a plurality of sections;

the degree of influence of air entering is set for each of the sections; and the estimation unit estimates an amount of air entering for each of the sections, and estimates an amount of air entering for the entire chiller from the estimated amount of air entering for each of the sections.

8. The control device according to claim 2, wherein the degree of influence of air entering is set according to a joint structure and a number of joints.

9. The control device according to claim 3, wherein the degree of influence of air entering is set according to a joint structure and a number of joints.

10. A chiller that uses low pressure, low global warming potential refrigerant, comprising:

a bleed device; and the control device according to claim 2.

11. A chiller that uses low pressure, low global warming potential refrigerant, comprising:

a bleed device; and the control device according to claim 3.

12. A chiller that uses low pressure, low global warming potential refrigerant, comprising:

a bleed device; and the control device according to claim 4.

* * * * *